US005470057A

United States Patent [19]

Bodford, Jr.

[11] Patent Number: 5,470,057

[45] Date of Patent: Nov. 28, 1995

[54] PADDLE GAME

[75] Inventor: Robert E. Bodford, Jr., Winston-Salem, N.C.

[73] Assignee: Paddle Games Unlimited, Inc., Winston-Salem, N.C.

[21] Appl. No.: 382,967

[22] Filed: Feb. 2, 1995

[51] Int. Cl.[6] ..... A63B 67/04

[52] U.S. Cl. ..... 273/30; 273/342; 273/402

[58] Field of Search ..... 273/30, 342, 402

[56] References Cited

U.S. PATENT DOCUMENTS

| | | | |
|---|---|---|---|
| 746,993 | 12/1903 | Roat, Jr. | 273/402 X |
| 2,161,463 | 6/1939 | Frost | 273/30 |
| 2,247,657 | 7/1941 | Girden | 273/30 |
| 2,504,818 | 4/1950 | Findon | 273/402 |
| 2,688,484 | 9/1954 | Garber | 273/30 |
| 2,926,914 | 3/1960 | Miller | 273/30 X |
| 3,231,277 | 1/1966 | Holland | 273/30 |
| 3,468,536 | 9/1969 | Minshull et al. | 273/30 |
| 3,480,273 | 11/1969 | Wise | 273/402 X |
| 3,655,187 | 4/1972 | Pugsley | 273/30 |
| 3,671,040 | 6/1972 | Meyer et al. | 273/342 |
| 3,891,210 | 6/1975 | Van Horne | 273/30 |
| 3,942,795 | 3/1976 | Psenka | 273/30 |
| 4,089,522 | 5/1978 | Rock | 273/30 |
| 4,345,758 | 8/1982 | Kempf | 273/30 |
| 4,457,513 | 7/1984 | Thompson | 273/342 X |
| 4,762,321 | 8/1988 | Chang | 273/30 |
| 4,765,619 | 8/1988 | Cooper | 273/30 |

FOREIGN PATENT DOCUMENTS 3519745 12/1986 Germany .

*Primary Examiner*—William H. Grieb

*Attorney, Agent, or Firm*—Bell, Seltzer, Park & Gibson

[57] ABSTRACT

A paddle game and method of preparing same for play is provided, having an elongate deflector adapted for resting on a table top. The deflector has a generally triangular configuration when viewed in cross section and has two substantially solid opposing angular playing surfaces which extend toward each other in intersecting planes to define an apex. A preselected game board is removably positioned on and cooperates with the deflector so that the game board extends generally vertically above the apex of the deflector. The game board has a target such as one or more openings therein for use by the players.

49 Claims, 11 Drawing Sheets

FIG. 1.
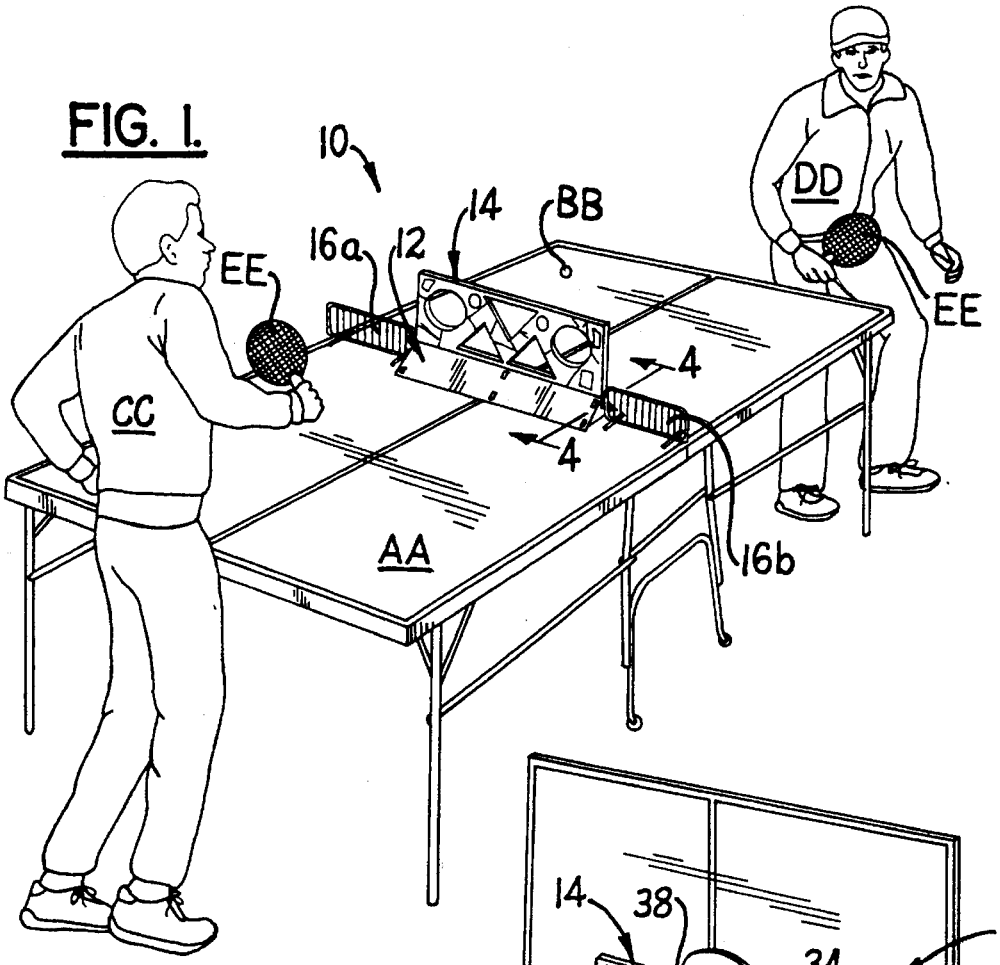
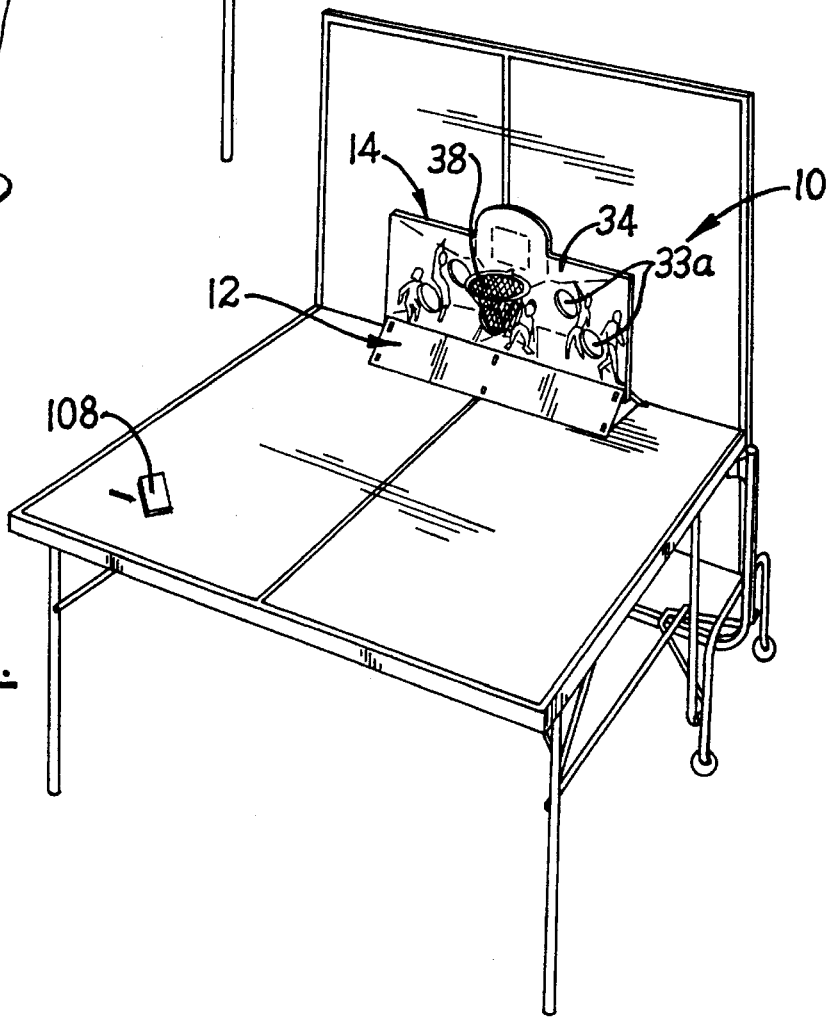
FIG. 2.

PADDLE GAME

FIELD OF THE INVENTION

The present invention relates to the field of paddle games and, more particularly, to a table top paddle game and a method of preparing same.

BACKGROUND OF THE INVENTION

The game of table tennis and similar paddle games have long been a popular pastime of both children and adults. Various rebounding devices and modifications to the game have developed over time in an attempt to add variety to and avoid boredom associated with repeatedly playing the same game.

For example, U.S. Pat. No. 2,161,463 to Frost discloses a ball returning target having a plurality of hinged panels which are positionable in a variety of configurations. Regardless of the configuration, the device is intended to be used with the traditional table tennis net so that an individual can use the device to rebound the ball for play on one side of the table.

Similarly, U.S. Pat. No. 3,942,795 to Psenka discloses a table tennis game having a rebound board positioned on the table tennis table which is retained in an incline position by a leg. The player attempts to hit a ball into an opening formed in the board. A guide structure and a notched opening return the ball to the player if successful, otherwise the ball will rebound off of the board. The board is surrounded by a net to return misdirected balls back to the player.

German Patent Application No. DE 3519-745-A to Ponsa discloses a table-tennis-like game having a table top which is divided into two areas. A rebound strip is mounted across a dividing line of the table and spans the table's widthwise distance. The strip has two playing surfaces facing away from each other and is elevated above the table to allow the table to be collapsed into a storage position.

U.S. Pat. No. 2,247,657 to Girden discloses the use of a rebound board having a vertically extending portion and an angled portion. The device is intended to be used by one or more players located on one end of the table. The rebound board does not allow for interactive competition by players located on opposed sides of the rebound board.

Despite these modifications and variations to the game of table tennis, involvement by children and adults in table tennis and related paddle games has greatly declined. Game manufacturers face a difficult task, in attempting to develop a new game or modify an existing game, in an effort to revive the popularity of table tennis and related paddle games.

SUMMARY OF THE INVENTION

An object of the present invention is to provide a new paddle game capable of providing a player with an almost infinite number of games that can be played.

These and other objects, features, and advantages of the present invention are obtained by providing a paddle game which has an elongate deflector adapted for resting on a table top. The deflector has a generally triangular configuration in cross section and two substantially solid opposing angular playing surfaces which extend toward each other in intersecting planes to define an apex. The deflector also has a length sufficient to extend across a major portion of the width of the table top. A preselected game board is removably positionable on and cooperates with the deflector for rebounding a game ball, such as a table tennis ball, back to the player. The game board extends generally vertically above the apex of the deflector and includes means for defining a target associated therewith.

If the deflector is used on a regulation table tennis table or a table of similar width, a pair of fences are preferably provided on opposed ends of the deflector to serve as extensions thereof. Advantageously, the fences each extend vertically upward a distance substantially equal to the height of the deflector.

Preferably, the preselected game board is but one of a plurality of game boards. To increase the variety of games that can be played by using the plurality of game boards and the deflector, preferably some of the game boards have printed indicia representing a different game on each face thereof to be selectively played by one or more players positioned on the same side of the deflector. Advantageously, some of the game boards have printed indicia representing the same game on each face thereof to be simultaneously played by players positioned on opposed sides of the deflector. To improve the aesthetic appeal of the game boards, it is desirable to have the printed indicia located on each face preferably be of a competitive game, such as an athletic event, i.e., golf or basketball.

At least some of the game boards also preferably include one or more openings which may be used as targets for each of the players. Alternatively, the game board may be provided with additional pieces such as a basketball goal which can serve as a primary or auxiliary target for use by the players. A further alternative is to provide other game pieces which can preferably be knocked over or off of the game board by the players to enhance the enjoyment of and increase the variety of the game.

To enable easy and quick changes between the game board positioned on the deflector, it is preferable for the deflector to have an open-topped receiving channel located in an apex portion thereof. Ideally, the receiving channel has an inwardly decreasing width so that the game board can be wedged tightly therein to maintain its position during play. Alternatively, if the deflector is made from a plastic, it is preferable for the receiving channel to be formed from a pair of sidewalls which are biased inward toward each other, thereby restricting access to the receiving channel to pinch the game board therebetween.

The opposed playing surfaces of the deflector are preferably angled between 40 and 50 degrees, and are ideally each at an angle of 45 degrees. This angle allows each player to both keep the ball in play for an extended period of time and allow each player to use the deflector to vary the game by setting up smash shots, etc.

A preferred alternative embodiment of the game includes a game table which is slightly smaller than a conventional table tennis table. As a result, the deflector ideally extends the entire width of the game table thereby avoiding the need for the pair of fences to be positioned on opposed sides thereof. Preferably, the game table has a pair of opposed leaves which cooperate with a center section of the game table to define a playing surface. Advantageously, each of the leaves is separately movable between a storage position and a use position such that a player can raise only one leaf and position the game table adjacent a solid object, such as a wall, for solitary play. Preferably each of the leaves is supported by a Z-shaped support, when viewed in horizontal cross section, and is hingedly connected to the center section; Preferably each support is made from a three legged assembly which has a first leg or segment and a second leg or segment hingedly connected at opposed ends to a third leg or segment. This configuration ensures that each of the leaves is supported across a major portion of both its length and width by the support. This cooperation between the pair of supports and the leaves results in a very versatile game table which still has a solid playing surface for players to enjoy. Preferably, the game table has a storage compartment and a storage drawer positioned below the center section to allow for storage of the game boards, the deflector and other elements of the paddle game. In addition, it is preferably for wheels to be positioned below each corner of the storage compartment and below each segment of each support to facilitate assembly and any desired movement of the table.

The ability of the deflector to be used to play a variety of different games without a game board and its ability to interchangeably receive a plurality of game boards such as basketball goals and volleyball nets provides players with an almost infinite number of individual games to play. In addition, because of this cooperation of the game board and the deflector, the game ball, such as a table tennis ball, remains almost constantly in play. As a result, players' skills improve quickly because time is spent playing the variety of games rather than chasing any misdirected balls. The great versatility of the paddle game also has the benefit of providing players with a large number of choices, thereby avoiding the boredom normally associated with conventional paddle games.

BRIEF DESCRIPTION OF THE DRAWINGS

Some of the objects, features, and advantages of the invention having been stated, others will appear as the description proceeds when considered in conjunction with the accompanying drawings, in which:

FIG. 1 is a side view in perspective of the paddle game in accordance with the present invention;

FIG. 2 is a side view in perspective of the paddle game wherein one or more players maybe positioned on one side of the deflector;

DETAILED DESCRIPTION OF THE PREFERRED EMBODIMENTS

Figure 3:
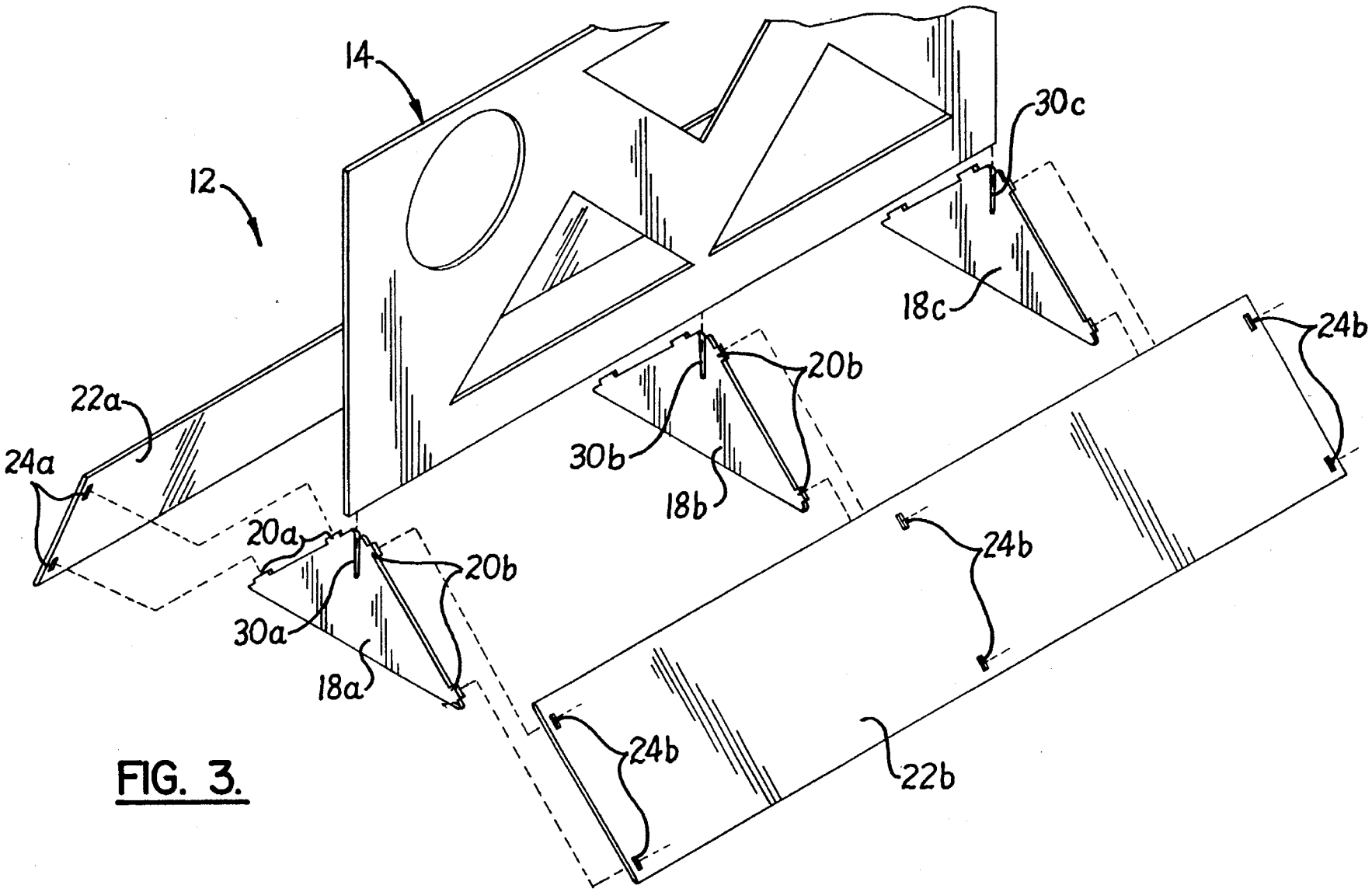
FIG. 3 is an exploded view of the preferred embodiment of the deflector in accordance with the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring now to the drawings, as shown in FIGS. 1–4B, the preferred embodiment of the invention includes a deflector, generally indicated as 12, which is adapted to be positioned on a table, such as a regulation sized table tennis table AA and receive a preselected game board, generally indicated as 14. A pair of barrier walls or fences **16*a* and 16*b* respectively, are positioned at opposed ends of the deflector 12** when the deflector is positioned on a table, such as a regulation table tennis table having a width wider than the deflector.

THE DEFLECTOR

As shown in FIGS. 1–4B, the preferred embodiment of the deflector 12, has a generally triangular configuration when viewed in cross-section and is elongate so as to extend across a major portion of the width of a table top AA, such as that shown in FIGS. 1 and 2. As illustrated best in FIG. 3, the deflector 12 is formed from a plurality, in this case three, generally triangular supports **18*a*–18*c*. Each of the supports 18*a*–18*c*, has a pair of longitudinally aligned protrusions 20*a* and 20*b*** formed on each opposed upwardly inclined surface thereof.

Figure 4A:
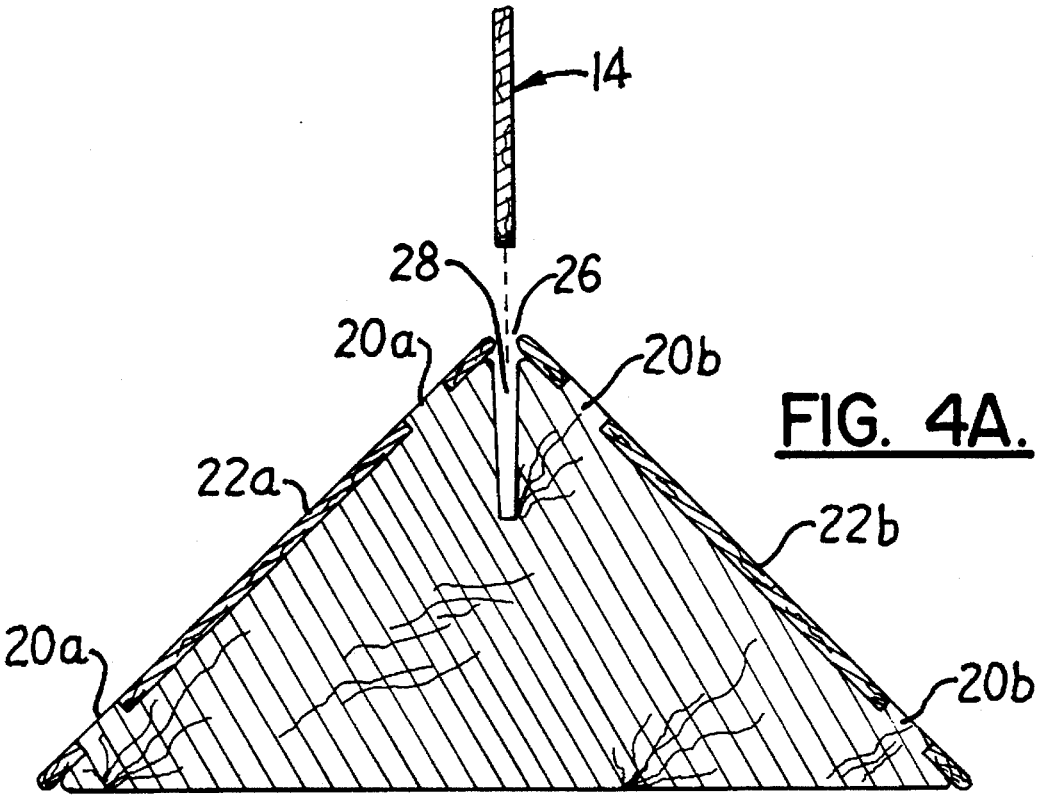
FIG. 4A is a partially exploded cross-sectional view of the deflector and a preselected game board.
Figure 4B:
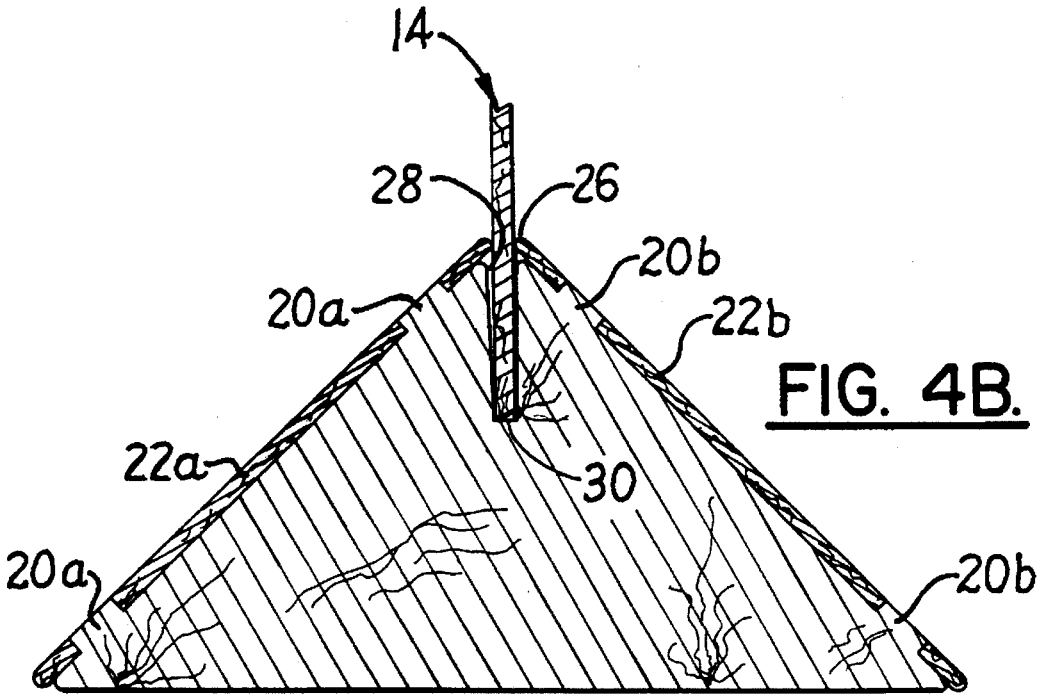
FIG. 4B is a view similar to that shown in FIG. 4A wherein the preselected game board is inserted into the open top receiving channel.

A pair of generally rectangular panels 22*a* and 22*b*, each have a pair of notches 24*a* and 24*b* respectively, which are adapted to receive the corresponding protrusions 20*a* and 20*b* of the respective supports 18*a*–18*c*. The number of pairs of notches 24*a* and 24*b* corresponds to the number of supports 18*a*–18*c* being used. As shown by comparing FIGS. 3 and 4A, the protrusions 20*a* and 20*b* extend through the respective notches 24*a* and 24*b* to support the respective panels 22*a* and 22*b* in alignment with the inclined sides of each of the supports 18*a*–18*c* to form an integral unit. To ensure that the panels 22*a* and 22*b* remain in position, conventional bonding glue is used to secure all engaging surfaces of the supports 18*a*–18*c* with the two panels 22*a* and 22*b*. As shown in FIGS. 4A and 4B, the protrusions 20*a* and 20*b* are sized to secure the panels 22*a* and 22*b*, so that the deflector 12 has a pair of opposed substantially smooth playing surfaces. The opposed playing surfaces, defined by panels 22*a* and 22*b*, extend toward each other in intersecting planes to define an apex 26. In addition, it may also be seen that the opposed playing surfaces each have a similar angle of approximately 45 degrees. Rather than using three supports 18*a*–18*c*, it is also possible to use just two supports in forming the deflector 12.

An open-topped receiving channel 28 is formed in the region of the apex 26 of the deflector 12 by an open-topped cut out 30*a*–30*c* formed in each of the respective supports 18*a*–18*c*. As best shown in FIGS. 4A and 4B, the resultant open-topped receiving channel 28 has an inwardly decreasing width wherein the width adjacent its open end, which in the embodiment shown is approximately 0.200 inches, is wider than the width adjacent its closed end, which is approximately 0.180 inches. The overall length of the receiving channel 28 is approximately 1.75 inches. Consequently, as the preselected game board is inserted into the receiving channel 28, the game board is wedged tightly therein to maintain its position during play, while allowing for easy and quick changes between game boards 14. By inserting the preselected game board 14 into the open-topped receiving channel 28, the preselected game board extends vertically upward from the apex 28 of the deflector 12 and, as explained in detail below, becomes an integral part of the paddle game 10.

The preferred embodiment of the deflector 12 has a height at its apex 26 substantially similar to that of a conventional table tennis net, namely seven inches. At its base, the deflector 12 has a width of approximately eleven inches and has an overall length of approximately thirty-three inches. It is to be understood however that these dimensions may vary as desired and remain within the spirit of the invention. Although the deflector 12 is well suited for use with a game board 14, it may also be placed on the table AA and used to play a variety of different games without positioning a game board therein.

THE GAME BOARDS

Figure 10A:
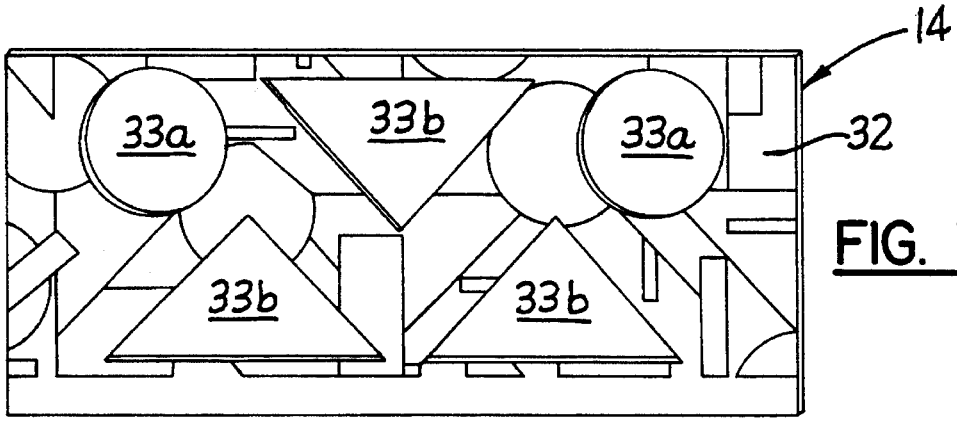
FIG. 10A is a side view in perspective of the Quoin Advantage game board.
Figure 10B:
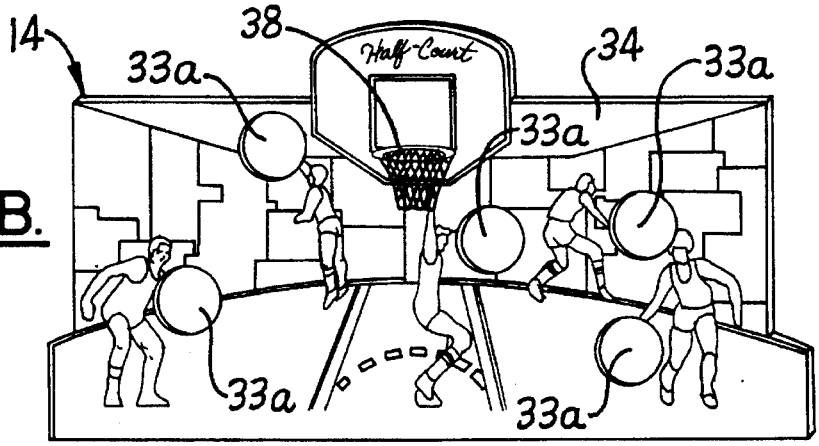
FIG. 10B is a side view in perspective of the Half Court game board.
Figure 10C:
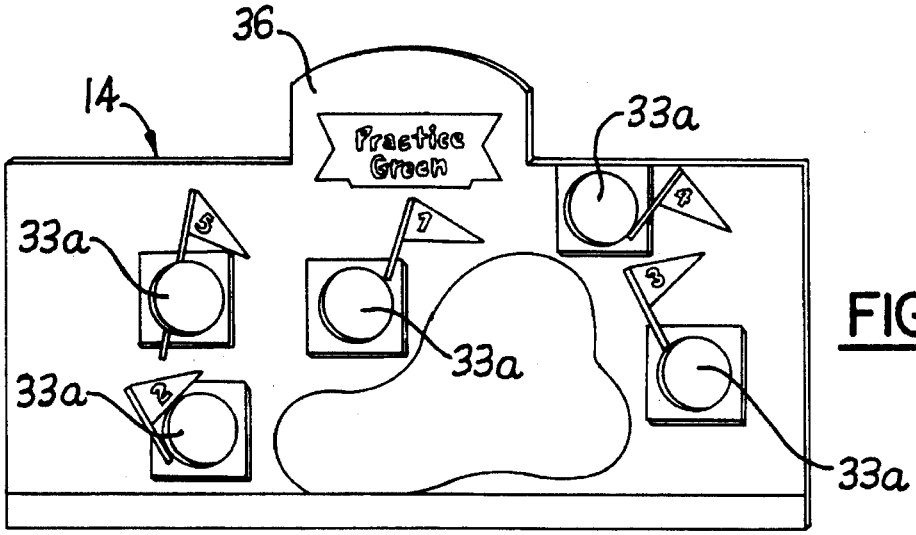
FIG. 10C is a side view in perspective of the Practice Green game board.

The preselected game board 14 shown in FIGS. 1–4B, is one of a group of game boards. As currently sold, only two game boards 14, i.e., the game boards shown in FIGS. 10A–10C, are sold with the deflector 12 at the time of purchase. The remaining game boards 14 may be obtained as desired.

Figure 10D:
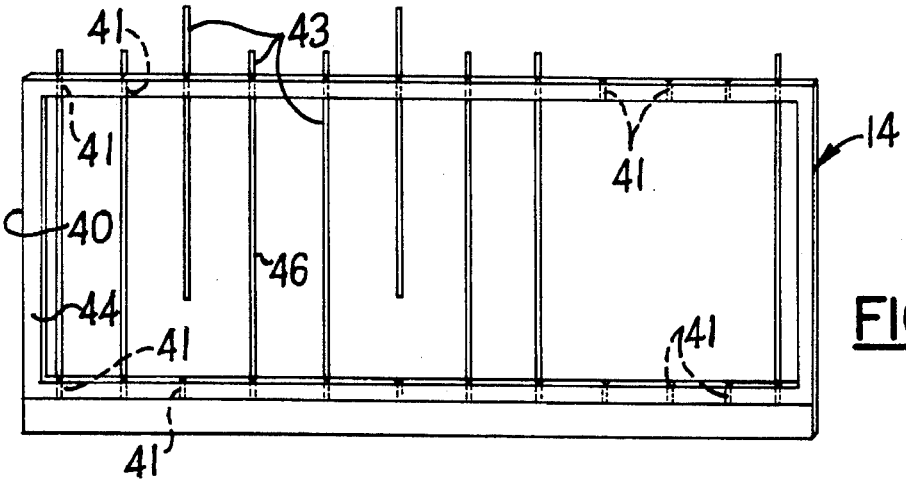
FIG. 10D is a side view in perspective of the Breakout game board.
Figure 10E:
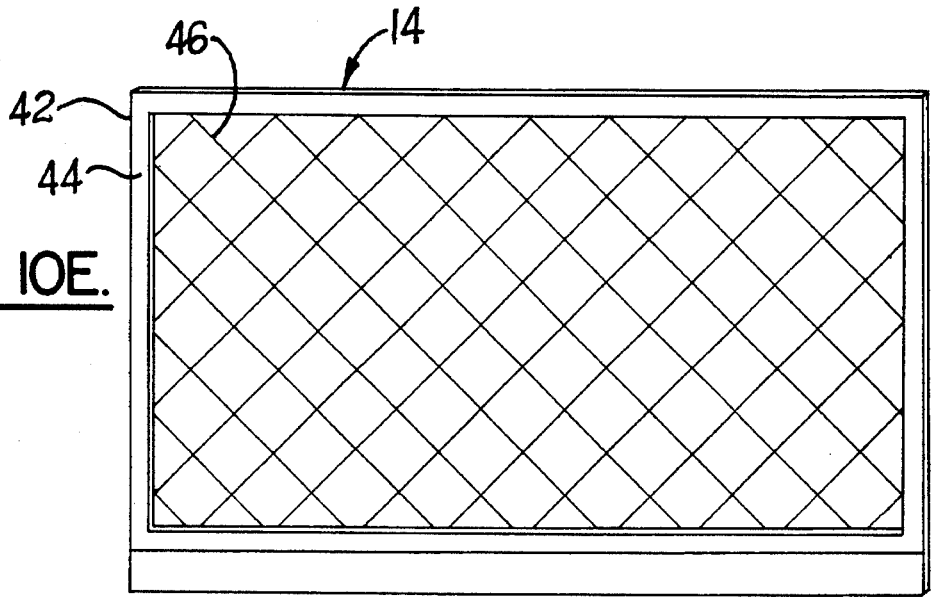
FIG. 10E is a side view in perspective of the Gridiron game board.
Figure 10F:
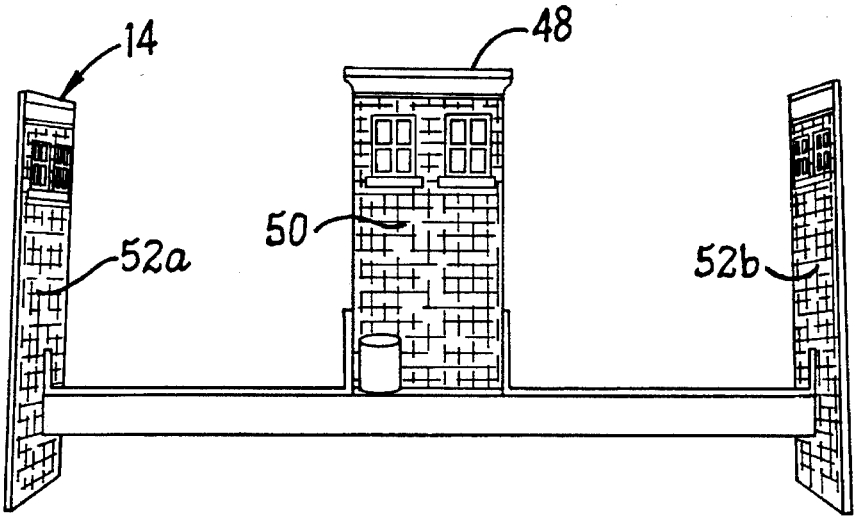
FIG. 10F is a side view in perspective of the Blind Alley game board.
Figure 10G:
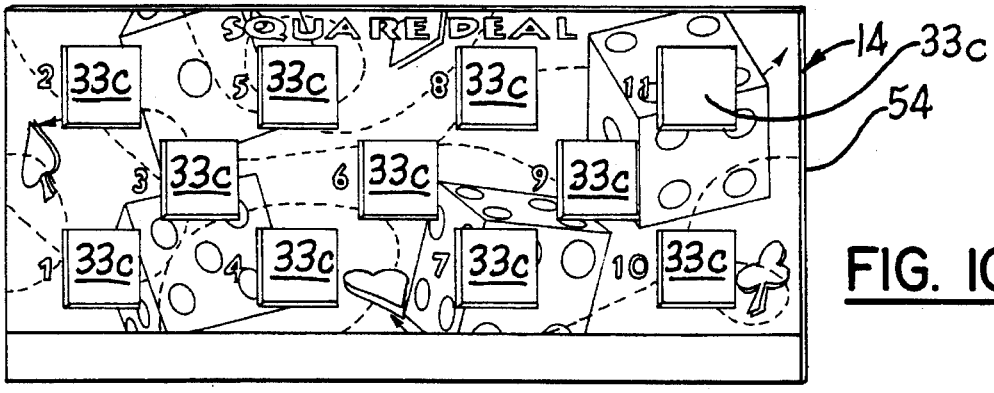
FIG. 10G is a side view in perspective of the Square Deal game board.
Figure 10H:
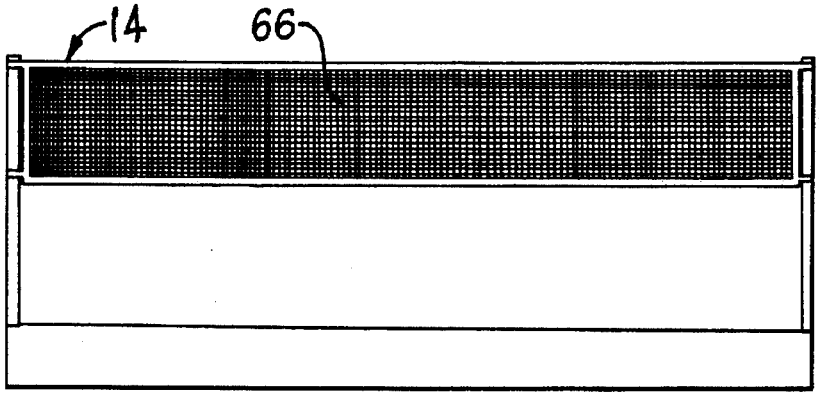
FIG. 10H is a side view of the Volley Quoin game component.
Figure 10I:
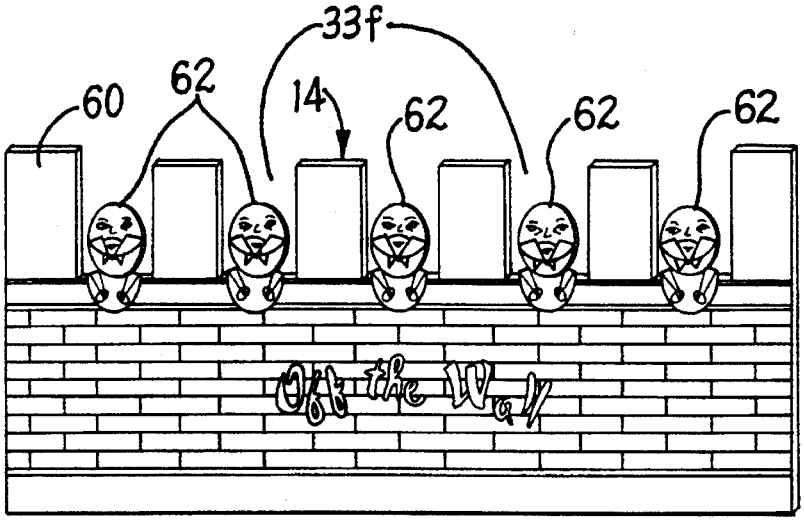
FIG. 10I is a side view in perspective of the Off The Wall game board.
Figure 10J:
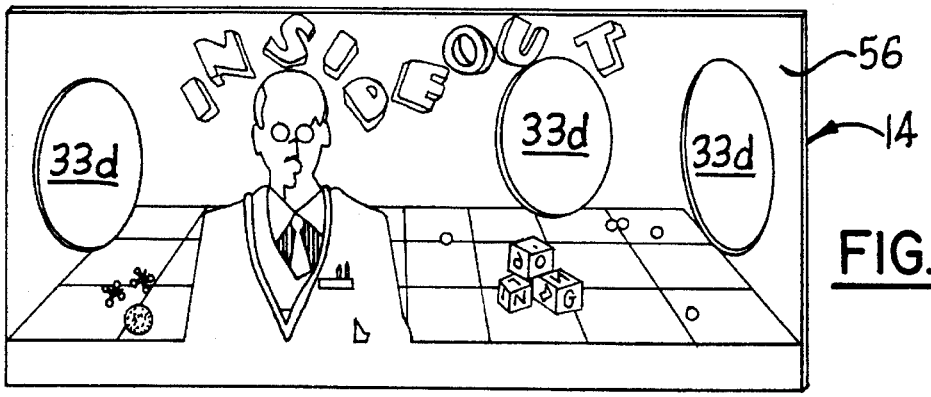
FIG. 10J is a side view in perspective of the Inside Out game board.
Figure 10K:
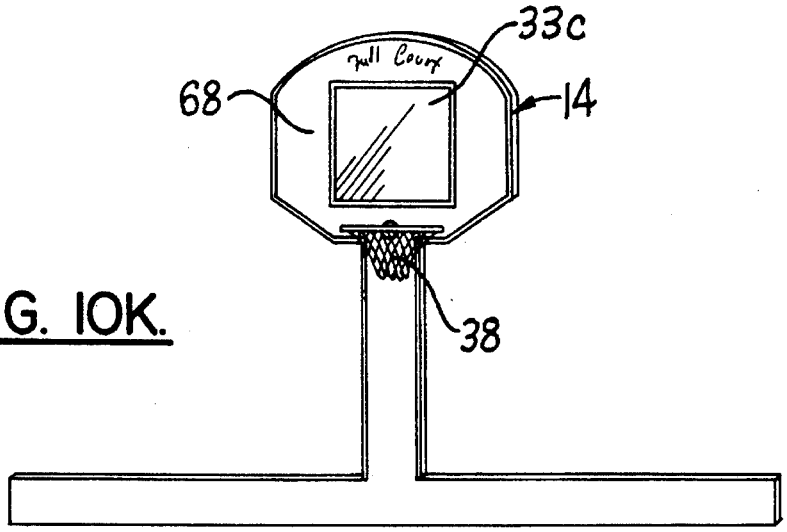
FIG. 10K is a side view in perspective of the Full Court game component.

The term game board 14 as used herein is used generically to identify not only the generally rectangular boards shown in FIGS. 1, 2, 7, 8, 10A–10E, 10G, 10I, 10J and 10L, but also those boards illustrated in FIG. 10F which include a pair of transverse side boards, FIG. 10H which includes a volleyball net, and FIG. 10K which includes a basketball goal. Each of the game boards 14 and the deflector 12 is made from a material such as hard board which is both lightweight yet durable and sufficiently resilient to allow a game ball BB to rebound off of the game board without a significant reduction in speed. Alternative materials, such as plastic, may be used to construct both the deflector 12 and the game boards 14, provided the desirable weight, durability and resiliency characteristics are maintained. In the embodiments shown, the game boards 14 have an approximate length of 33 inches and a height of 15 inches. As a result, the combined height of the game board 14 and the deflector 12 is less than the height of the table AA.

FIGS. 10A–10L illustrate the game boards and game components currently available for use with the deflector 12. It is to be understood however, that a large number of alternative games may be played with the game boards and components described below and a large number of alternative game boards may be used with the deflector 12 and remain within the spirit of the present invention. Each of the game boards 14 defines at least one different game interchangeably useable with the deflector 12. Specifically, referring to FIG. 10A, the game board shown is a Quoin Advantage game 32 which has a generally rectangular configuration and has a plurality of round openings 33*a* and a plurality of triangular shaped openings 33*b* located therein. Each of the openings 33*a* and 33*b* are adapted to permit passage of a game ball such as a table tennis ball BB therethrough. The Advantage game 32 shown in FIGS. 1 and 10A has, as do all of the game boards 14 described below, printed indicia thereon which illustrates a competitive game or theme, such as an athletic event.

In the Advantage game 32, the same printed indicia i.e., game, appears on each opposed face thereof for use by players CC and DD respectively, positioned on opposing sides of the deflector 12. The openings 33*a* and 33*b* located on the face of the game board 14 are positioned in a random pattern. Alternatively, the openings may be organized by size, shape and/or location on the game board 14 based on corresponding degrees of difficulty or other predetermined factors.

Conversely, FIGS. 10B and 10C each show an alternative embodiment of the game board 14 which has a Half Court game 34 on one face thereof and a different game, namely a Practice Green game 36, printed on the opposed face thereof. The game board 14, made up of the Half Court game 34 and the Practice Green game 36, shown in FIGS. 2, 10B and 10C is intended to be used by one or more players positioned on the same side of the deflector 12. The Half Court game 34 also includes an additional game piece 38 in the form of a basketball goal which projects forwardly from the game board 14 and is medially located thereon. The basketball goal is adapted to allow passage therethrough of a game ball BB.

FIG. 10D shows a Breakout game 40 and FIG. 10E shows a Gridiron game 42. Each game board 14 has a peripheral frame 44 made of the same hard board or a similar material used in the other game boards. The frame 44 used in the Breakout game 40 has a plurality of equally spaced pairs of opposed holes 41 formed therein in parallel alignment. Each pair of opposed holes is adapted to receive therein a dowel 43 made of a lightweight durable and resilient material such as wood or plastic. The frame 44 holds a plurality of the equally spaced removable dowels 43. The dowels may be inserted and/or removed as desired by the players to increase or decrease the difficulty of the game.

In the Gridiron game 42 the frame 44 is used to attach wire or string 46 in a generally diagonal arrangement. The wire or string 46 may be made from a conventional tennis string material or any wire or string which is easy to tie and sufficiently flexible or resilient to withstand repeated contact by the game ball BB.

A Blind Alley game 48 is illustrated in FIG. 10F. As shown, the Blind Alley game 48 is made up of a center board 50 and a pair of opposed side boards 52*a* and 52*b* respectively. The side boards 52*a* and 52*b* are oriented generally transverse to the center board 50 and are intended to be positioned on opposed sides of the deflector 12.

FIG. 10G illustrates a Square Deal game 54 which has a plurality of square openings 33*c* located therein for use by players positioned on both sides of the deflector 12.

Figure 10L:
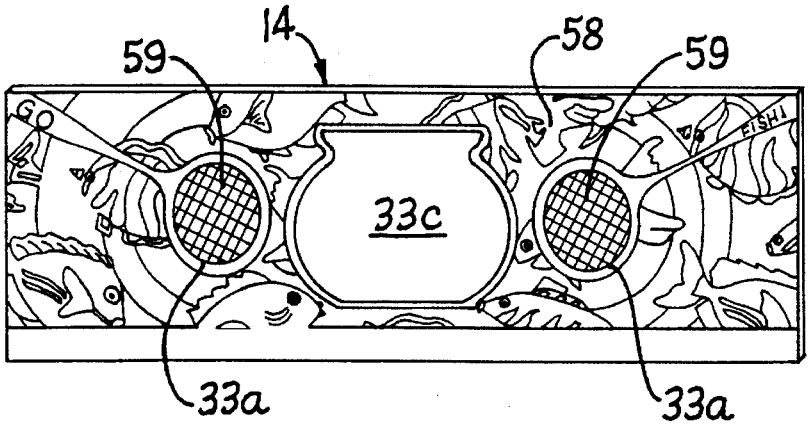
FIG. 10L is a side view in perspective of the Fish Bowl game board in accordance with the present invention.

FIG. 10J illustrates an Inside Out game 56 which has a plurality of generally oval openings 33*d* for use by players positioned on both sides of the deflector 12. Similarly, FIG. 10L shows a Fish Bowl game 58, which has a generally bowl-shaped opening 33*e* positioned in a center portion thereof and opposed circular openings 33*a*. Each of the circular openings 33*a* has a loose net 59 positioned therein to capture a game ball BB. Conversely, FIG. 10I shows an Off The Wall game 60 which has a plurality of generally rectangular cutouts 33*f* positioned along an upper portion of the game board 14. Game pieces 62 in the shape of humpty dumpty eggs and are positioned upon a ledge formed by the cutouts 33*f*. The game pieces 62 are targets to be knocked down by one or more players positioned on opposed sides of the deflector 12.

FIGS. 10H and 10K show an alternative embodiment of the game boards shown in FIGS. 1–4B, 10A–10G, 10I, 10J, and 10L. In this instance, the game board 14, shown in FIG. 10H is a volleyball net 66 is adapted to be positioned above and extend generally upward from the apex 26 of the deflector 12 for use by players on opposed sides of the deflector. Similarly, FIG. 10K has a Full Court game 68 which has a basketball goal 38, positioned on both sides of the game board 14 for use by players positioned on opposed sides of the deflector 12. The Full Court game 68 has a generally square cutout 33*e* positioned in a center portion thereof. The square cutout 33*e* is filled with a resilient transparent material, such as plexiglass, to allow one or more players positioned on one side of the game board 14 to monitor scoring in the basketball goal 38 located on the opposing face thereof. Alternatively, the entire Full Court game 68 may be constructed from a transparent material having the desired durability and resiliency characteristics.

PLAYING THE GAME

To prepare the paddle game 10 for use by players positioned on opposed sides of the deflector 12, requires positioning the deflector widthwise along the center of the table AA so as to extend across a major portion thereof and thereby divide the playing surface substantially in half. If the table AA being used is wider than the deflector 12, then the barrier walls or fences 16*a* and 16*b* are positioned on opposed ends of the deflector 12 to serve as an extension thereof. As shown in FIG. 1, the fences each extend vertically upward a distance substantially equal to the height of the deflector 12.

A game board 14 is then selected based upon the game desired to be played and the number of players wishing to simultaneously play. The preselected game board 14 is then positioned or inserted into the receiving channel 28 to maintain the game board in the desired position during play. It is to be noted, however, that the receiving channel 28 need not extend the entire length of the elongate deflector 12, but may rather be formed from a plurality of smaller segmental receiving channels (not shown) and the respective game board shape will be adapted accordingly. Once the game 10 has been set up as shown in FIG. 1, the players CC and DD take positions on opposed ends of the deflector 12. Alternatively, one or more players may be positioned for play on only one end of the table AA. To allow one or more players to play from one side of the table requires the use of game board 14 having the Half Court game 32 and the Practice Green game 34 thereon. Each player has a paddle EE for projecting a game ball BB toward either the deflector 12 and/or the game board 14.

To begin play, one of the players serves the ball in much the same fashion as is used in table tennis. The ball may either pass through one of the openings 33 in the game board 14 or go over the top thereof. Alternatively, if the game board 14 has a game piece such as the basketball goal 38 or the humpty dumpty pieces 62 then the game ball BB may be also be hit toward these targets. If the game ball BB hits the game board 14, the ball is allowed to bounce once on the table and then be hit again. The game ball BB continues to be in play until it bounces twice on one side of the table AA before being hit by a player positioned on the same side or falls off of the table AA. The rules for playing each of the games represented by each of the individual game boards 14 shown in FIGS. 10A–10L are contained within a rule book 106.

ALTERNATIVE DEFLECTOR

Figure 5:
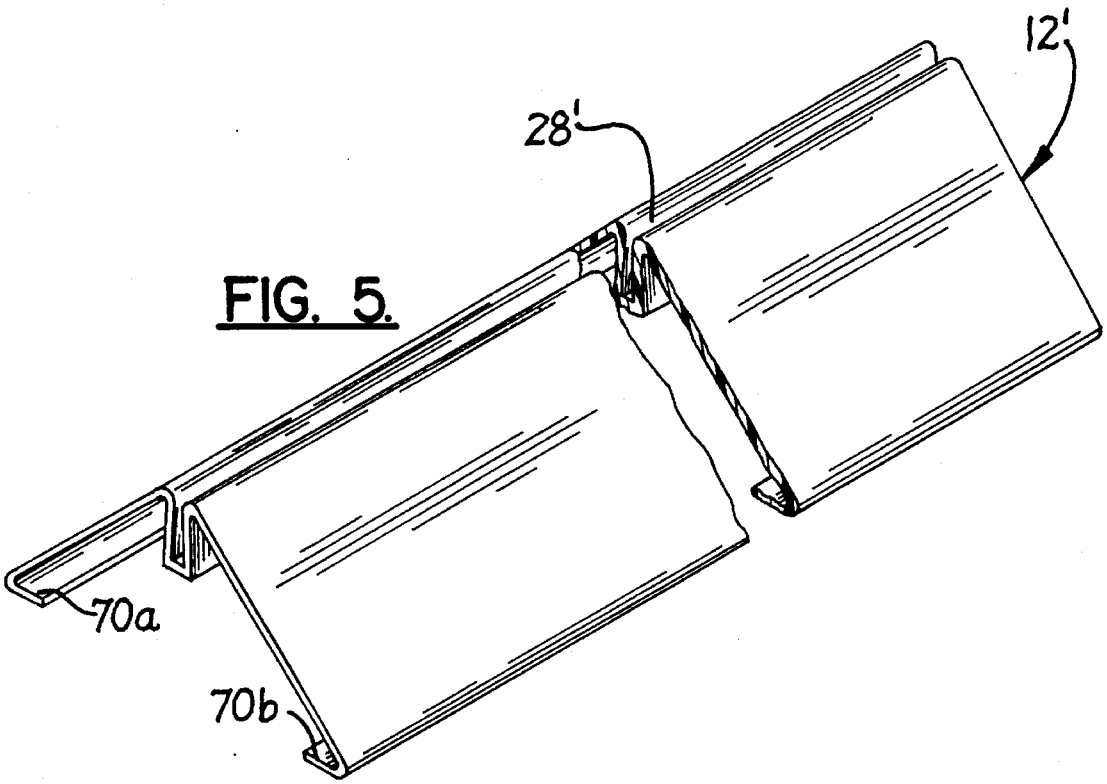
FIG. 5 is a side view in perspective and partially in cross-section in an alternative embodiment of the deflector in accordance with the present invention.
Figure 6A:
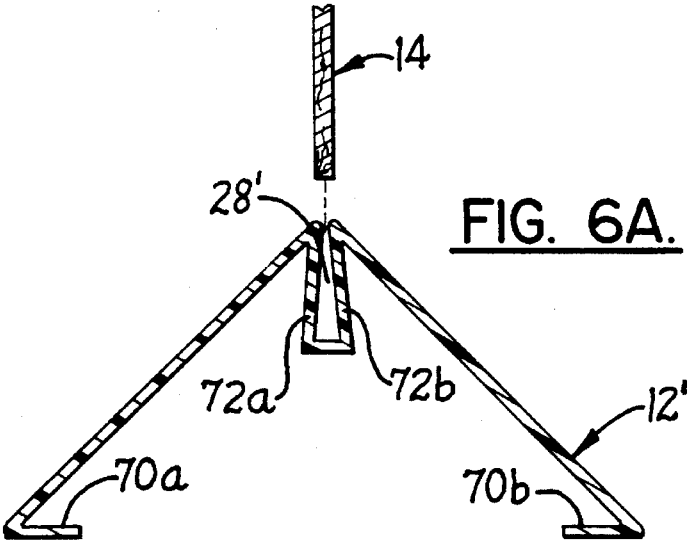
FIG. 6A is an exploded cross-sectional view of the deflector shown in FIG. 5 and a preselected game board.
Figure 6B:
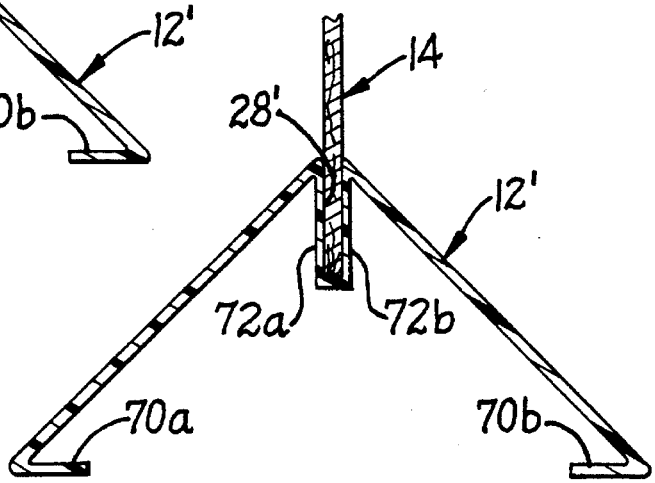
FIG. 6B is a cross-sectional view similar to that shown in FIG. 6A with the preselected game board inserted into the receiving channel of the deflector.

An alternative embodiment of a deflector 12' is shown in FIGS. 5, 6A and 6B. In this embodiment, the deflector 12' is not manufactured by the hardwood material used in the preferred embodiment shown in FIGS. 1–4B, but rather from a flexible plastic. In the embodiment shown, the deflector 12' also has a generally triangular configuration when viewed in cross-section. However, unlike the preferred embodiment, the deflector 12' includes a pair of opposed platforms 70*a* and 7O*b* respectively adapted for resting on the table top AA. In addition, as best shown in FIGS. 6A and 6B, the open-topped receiving channel 28' is formed from a pair of inwardly biased sidewalls 72*a* and 72*b* respectively, which restrict access to the receiving channel 28'. As a result of this configuration, the game board 14 is securely retained within the receiving channel 28' by pinching of the inwardly biased sidewalls 72*a* and 72*b*. In all other respects, the alternative embodiment of the deflector 12' has substantially the same dimensions and functions in the same manner as the previously described deflector 12 shown in FIGS. 1–4B.

GAME TABLE

Figure 7:
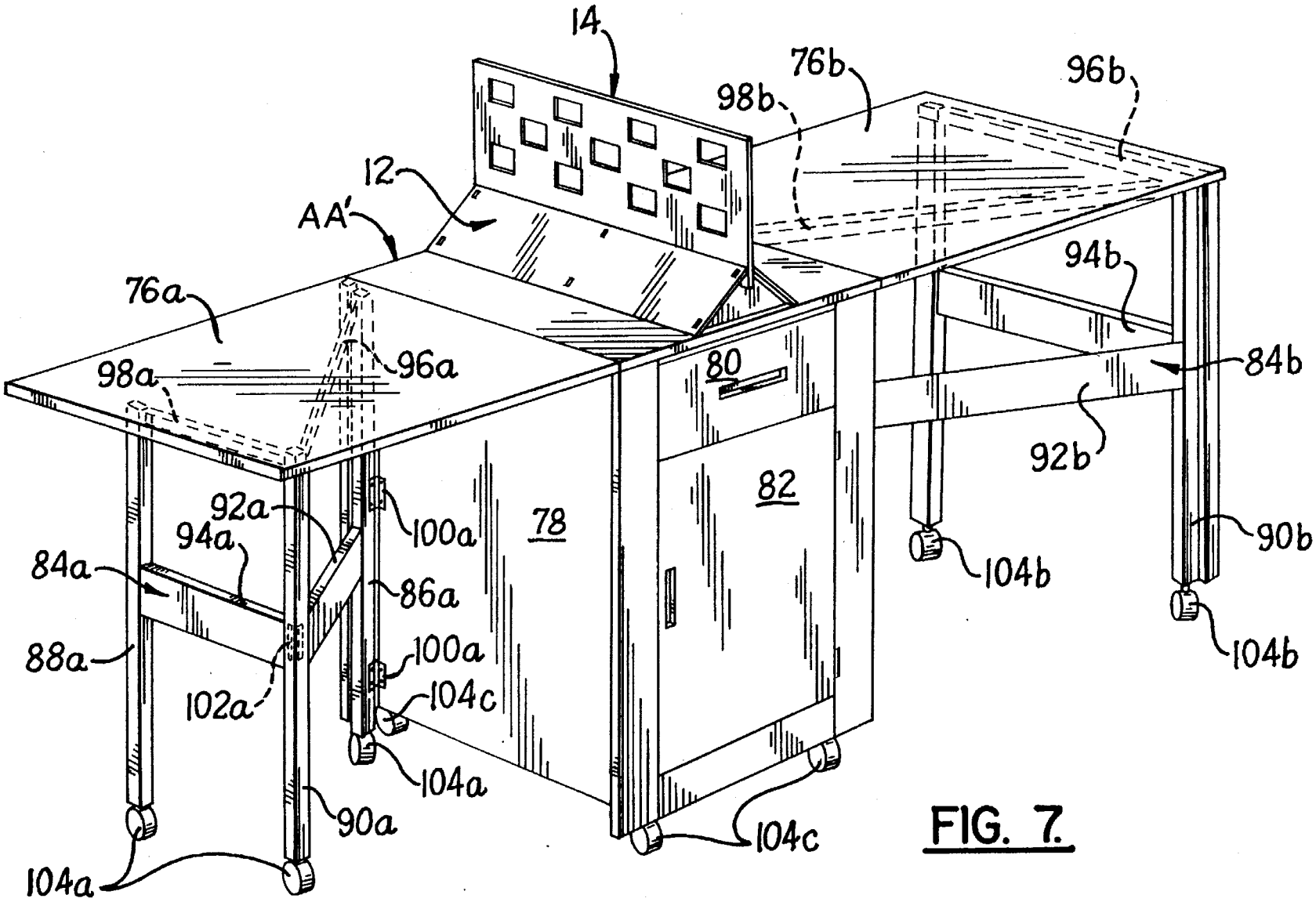
FIG. 7 is a side view and perspective of a game table with the opposed leaves in the use position in accordance with the present invention.
Figure 8:
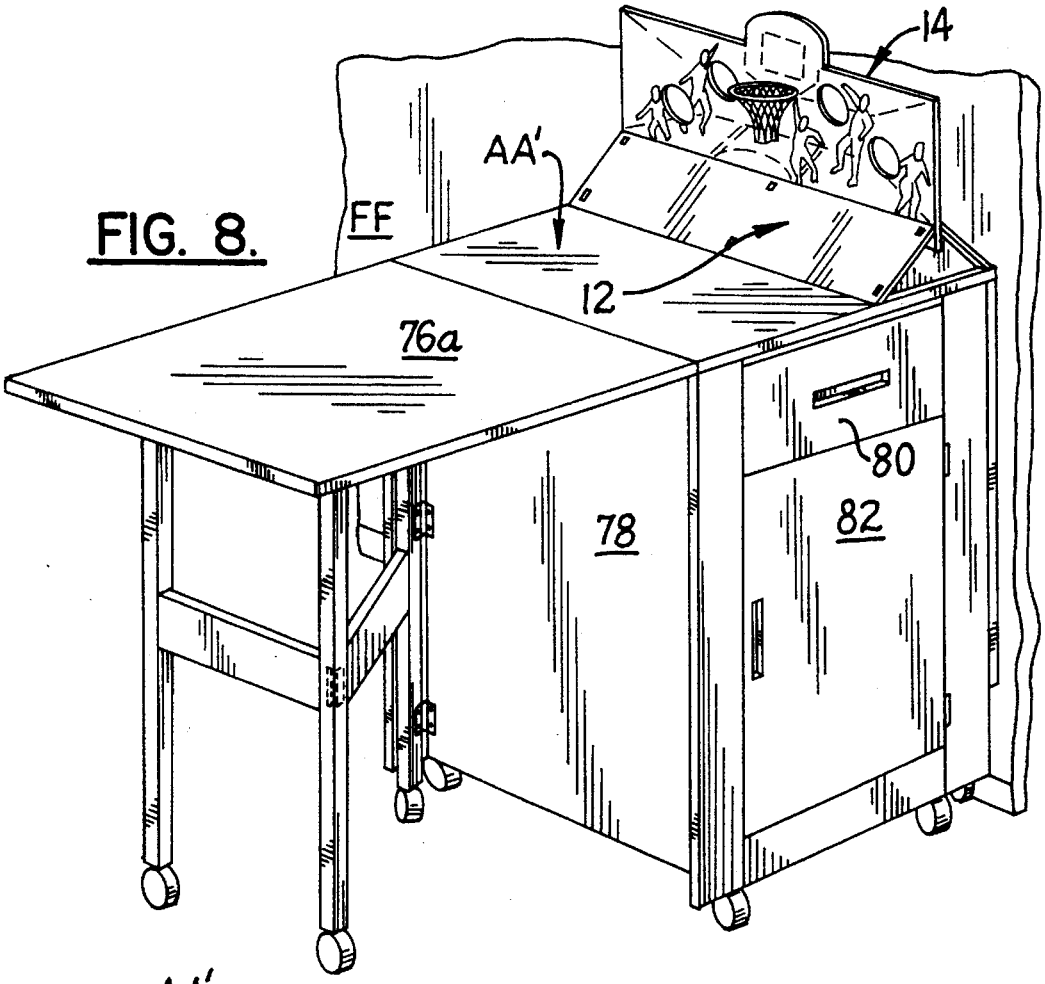
FIG. 8 is a side view in perspective of the game table shown in FIG. 7 with one of the opposed leaves in the stored position and the other leaf in the use position for use by one or more players on one side of the deflector.
Figure 9:
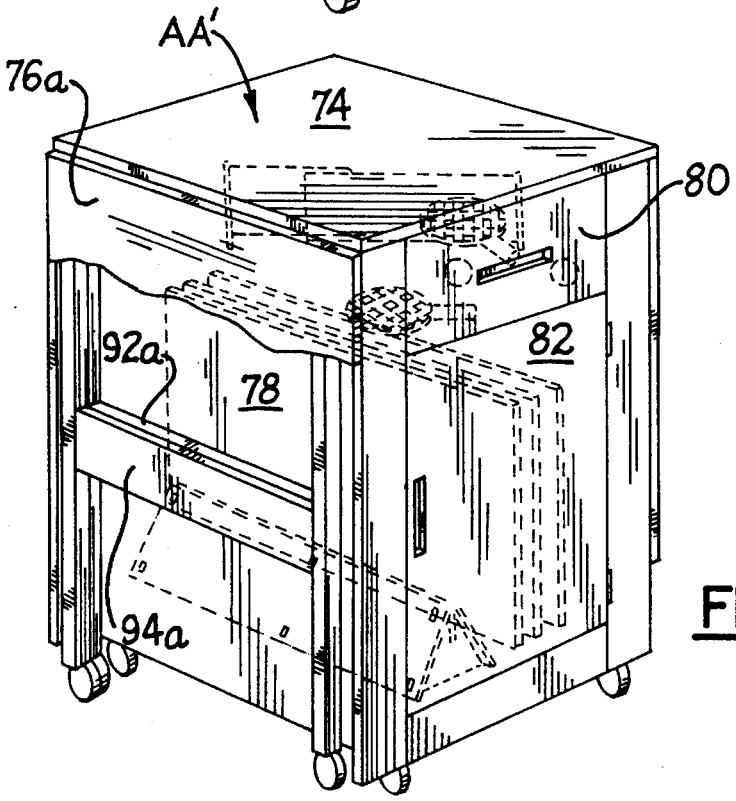
FIG. 9 is a side view in perspective of the game table showing the opposed leaves in the stored position and showing items stored therein in phantom.

FIGS. 7–9 illustrate a preferred embodiment of the game table AA' to be used. As shown, the game table AA' has a center section 74 and a pair of opposed leaves 76*a* and 76*b*. As may be seen by comparing FIGS. 7 and 9, the pair of opposed leaves 76*a* and 76*b* are moveable between a use position shown in FIG. 7 and a storage position shown in FIG. 9. In the use position, the opposed leaves 76*a* and 76*b* combine with the center section 74 to form a generally rectangular table top which defines a substantially uniform playing surface. As clearly illustrated in FIG. 7, the height of the game table AA' is approximately 30 inches and the width of the game table AA', i.e. its playing surface is approximately 33 inches, so that the elongate deflector 12 can extend across the entire width of the game table AA'. In addition, the overall length of the game table AA' is approximately 72 inches, which is somewhat smaller than the regulation table tennis table AA shown in FIG. 1. As a result, the game table AA' requires less room in which to play while improving the skill level of the players because of its smaller playing surface. The playing surface of the game table AA' is specially treated by painting or the like to produce a surface having the hardness and bounce characteristics similar to that of a traditional table tennis table.

As illustrated in FIG. 9, a storage compartment 78 is positioned below the center section 74 for storage of all elements associated with the paddle game 10. Specifically, as shown in FIGS. 7–9, the storage compartment 78 has a drawer 80 and a panel door 82. In an alternative embodiment thereof, the storage compartment 78 may be constructed without a panel door 80 to allow easier access to the stored items. As shown best in FIG. 9, the deflector 12, the plurality of game boards 14 and the game components 64 may be stored in the storage compartment defined by the panel door 82 and smaller items such as paddles EE, game balls BB and additional game pieces such as the basketball goal 38 and the humpty dumpty targets 62 may be stored in the storage area defined by the drawer 80.

If one or more players wishes to use the game board 14 shown in FIGS. 10B and 10C, then one of the pair of the opposed leaves **76*a* and 76*b* may be moved to the storage position, downwardly adjacent the storage compartment 78, in this case 76*b* and the other of the opposed leaves 76*a*, may be moved to the use position as shown in FIG. 8. To enhance enjoyment of either game, it is beneficial to move the game table AA against a solid object such as a door or a wall FF so as to provide an extended backstop and avoid having to chase down misdirected balls or balls that pass through openings 33*a***.

When not in use, both of the leaves **76*a* and 76*b* may be moved to the storage position shown in FIG. 9 and the game table AA' may be used either as a conventional table or moved into a desired storage location. Each of the leaves 76*a* and 76*b* are held in the use position by supports generally designated as 84*a* and 84*b* respectively. Each of the supports 84*a* and 84*b* has a generally "Z-shaped" configuration. For purposes of explanation, the structure of the supports 84*a* and 84*b* will be described in detail only with respect to support 84*a*. It is to be understood however, that support 84*b*** has the same components with a corresponding letter designation "b".

As shown in FIG. 7, the support **84*a* is a three legged assembly formed from a first section 86*a* and an opposed second section 88*a* which are both hingedly joined to a third section 90*a*. A pair of cross braces 92*a* and 94*a* are positioned between the first section 86*a* and the third section 90*a* and the second section 88*a* and the third section 90*a*, respectively. Corresponding upper cross braces 96*a* and 98*a* are in parallel longitudinal alignment with cross braces 92*a* and 94*a* respectively, to provide additional support for the leaf 76*a*. A pair of hinges 100*a* hingedly attach the first segment 86*a* to the storage compartment 78**.

This Z-configuration of the support **86*a* ensures that the support can move from a folded position adjacent to or alongside of the storage compartment 78 and an extended position underlying the leave 76*a* so as to extend across a major portion of both the length and the width of the leaf 76*a* to provide a solid playing surface. A third hinge 102*a* hingedly connects the first section 86*a* to the third section 90*a* and the second section 88*a* to the third section 90*a*** to allow hingable movement therebetween.

Each of the first section **86*a*, the second section 88*a*, and the third section 90*a* have casters 94*a* or other forms of rollable wheels attached at ends thereof to enable the supports 84*a* to easily move between the storage position and the extended position. Casters 94*c* are also positioned adjacent the four corners of the storage compartment 78** to allow the table to be easily assembled and facilitate any desired movement of the game table AA'.

THE PADDLE GAME AS SHIPPED

Figure 11:
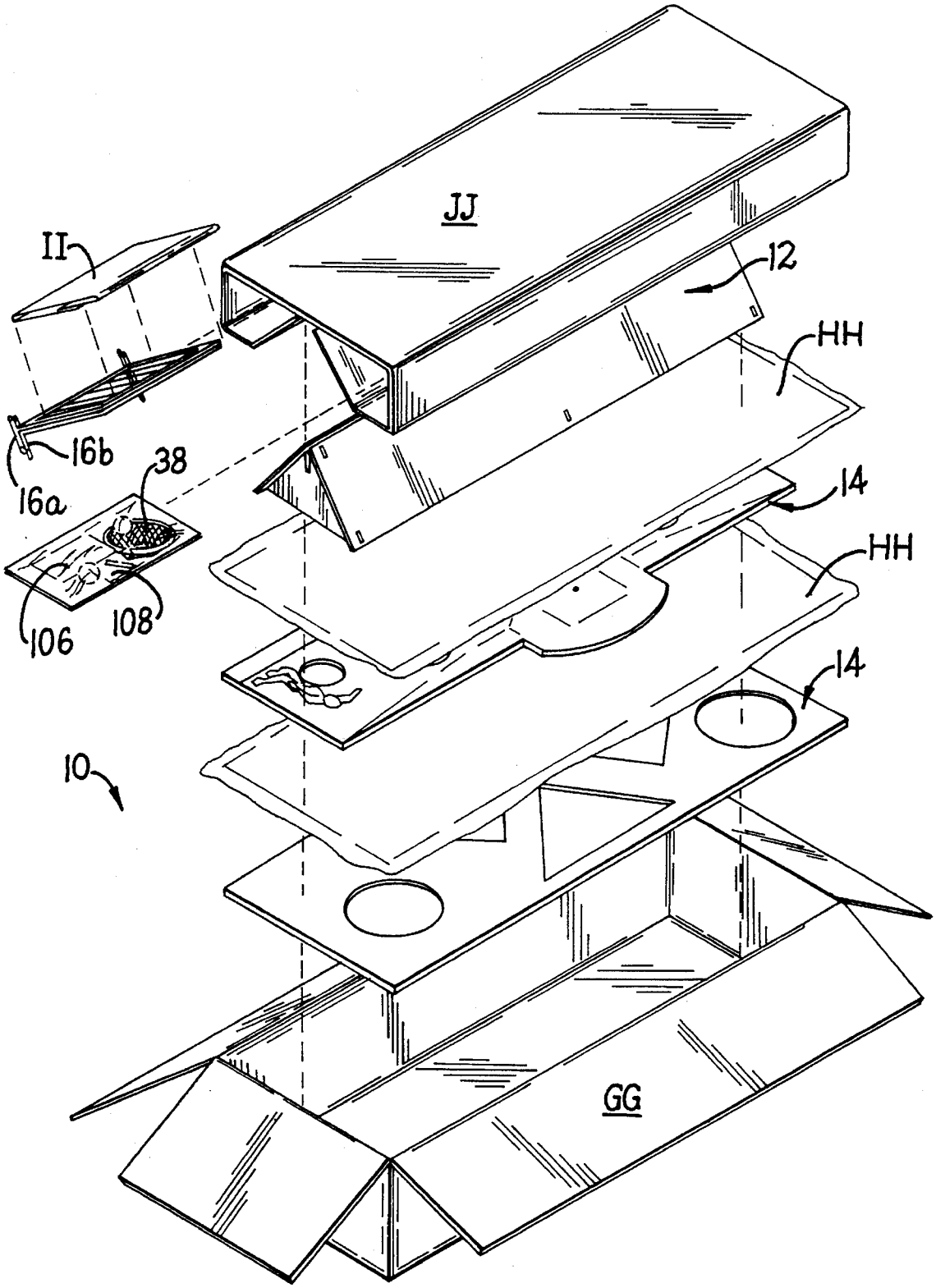
FIG. 11 is an exploded view of the elements of the paddle game shown in a shipping container in accordance with the present invention.

As shown in FIG. 11, the paddle game 10 after being solid is placed in a shipping container GG. The plurality of game boards 14, in this instance the game board shown in FIGS. 10A–10C are placed in the bottom of the shipping container GG. Packing paper HH is placed between and on top of the game boards 14 to protect the indicia of each game board from marring or damaged during storage and/or shipment. The deflector 12 is placed on top of the packing paper HH along with a copy of the rule book 106 and a bag containing additional game pieces such as the basketball goal 38 and a score pad 108. The pair of barrier walls or fences **16*a* and 16*b* are wrapped in protective paper II and placed in a convenient location within the container GG. A piece of protective cardboard JJ is placed above the deflector 12 to prevent excessive movement of the elements of the paddle game 10** during shipment.

Many modifications and other embodiments of the invention will come to mind in one skilled in the art to which this invention pertains having the benefit of the teachings presented in the foregoing descriptions and the associated drawings. Therefore, it is to be understood that the invention is not to be limited to the specific embodiments disclosed. Although specific terms are employed, they are used in a generic and descriptive sense only and not for purposes of limitation, and that modifications and embodiments are intended to be included within the scope of the following claims.

That which is claimed:

1. A paddle game comprising:

an elongate deflector adapted for resting on a table top, said deflector having a generally triangular configuration in cross section and having two substantially opposing angular playing surfaces which extend toward each other in intersecting planes to define an apex, and said deflector being of such a length as to extend across at least a major portion of the width of a table top; and a game board removably positioned on and cooperating with said deflector, said game board extending generally vertically above said apex of said deflector, and said game board having means defining a target associated therewith.

2. A paddle game according to claim 1 further comprising elongate barrier walls extending from opposed ends of said deflector.

3. A paddle game according to claim 2 wherein said barrier walls comprise a pair of fences removably positionable adjacent opposed ends of said deflector to serve as an extension thereof, and wherein each of said fences extends vertically upward a distance substantially equal to the height of said deflector.

4. A paddle game according claim 1 wherein said game board comprises one of a group of game boards, wherein each of said game boards defines a different game interchangeably useable with said deflector.

5. A paddle game according to claim 1 further comprising means associated with an apex portion of said deflector for maintaining said game board in position.

6. A paddle game according to claim 5 wherein said means for maintaining said game board in position comprises an open-topped receiving channel located in said apex portion of said deflector, and the width of said receiving channel being inwardly decreasing.

7. A paddle game according to claim 5 wherein said means for maintaining said game board in position comprises an open-topped receiving channel located in said apex portion of said deflector, and said receiving channel having inwardly biased sidewalls to restrict access to said receiving channel for resiliently grasping a selected game board therebetween.

8. A paddle game according to claim 7 wherein said deflector is formed of plastic.

9. A paddle game according to claim 1 wherein said opposed angular playing surfaces each defines an angle of between 40 and 50 degrees.

10. A paddle game according to claim 9 wherein said opposed angular playing surfaces each defines an angle of the same degree.

11. A paddle game according to claim 10 wherein said opposed playing surfaces each defines an angle of 45 degrees.

12. A paddle game according to claim 1 wherein said means defining a target associated with said game board comprises an opening of a size adapted to permit passage of a game ball, such as a table tennis ball, therethrough.

13. A paddle game according to claim 1 wherein said game board has printed indica on at least one face thereof depicting a particular competitive game, such as an athletic event, to be played.

14. A paddle game according to claim 1 wherein said game board comprises a different game depicted on opposed faces thereof and is adapted to be selectively played by one or more players positioned on the same side of the deflector.

15. A paddle game according to claim 1 wherein said game board comprises the same game depicted on opposed faces thereof adapted for use by players positioned on opposing sides of said deflector.

16. A paddle game according to claim 1 wherein said game board includes opposing generally transverse side boards.

17. A paddle game according to claim 1 wherein said game board has a forwardly projecting goal medially located thereon and having an opening therein of a size adapted to permit passage of a game ball, such as a table tennis ball, therethrough.

18. A paddle game comprising:

an elongate deflector adapted for resting on a table top, said deflector having a generally triangular configuration in cross section and having two substantially opposing angular playing surfaces defining an angle of the same degree, which extend toward each other in intersecting planes to define an apex, and said deflector being of such a length as to extend across at least a major portion of the width of a table top;

an open-topped receiving channel located in an apex portion of said deflector, and the width of said receiving channel being inwardly decreasing; and a game board removably positioned in said receiving channel and extending generally vertically thereabove and said game board having means defining a target associated therewith.

19. A paddle game according to claim 18 wherein said opposed playing surfaces each defines an angle of between 40 degrees and 50 degrees.

20. A paddle game according to claim 19 wherein said opposed playing surfaces each defines an angle of 45 degrees.

21. A paddle game according to claim 18 wherein said means defining a target associated with said game board comprises an opening of a size adapted to permit passage of a game ball, such as a table tennis ball, therethrough.

22. A paddle game according to claim 18 wherein said game board comprises a different game depicted on opposed faces thereof adapted to be played by one or more players positioned on the same side of the deflector.

23. A paddle game according to claim 18 wherein said game board comprises the same game depicted on opposed faces thereof adapted for use by players positioned on opposing sides of said deflector.

24. A paddle game according to claim 18 wherein said game board has a forwardly projecting basketball goal medially located thereon, and has an opening therein of a size adapted to permit passage of a game ball, such as a table tennis ball, therethrough.

25. A paddle game according to claim 18 wherein said game board comprises a volleyball net.

26. A paddle game comprising:

an elongate deflector adapted for resting on a table top, said deflector having a generally triangular configuration in cross section and having two substantially opposing angular playing surfaces defining an angle of the same degree, which extend toward each other in intersecting planes to define an apex, said deflector having a height substantially corresponding to the height of a conventional table tennis net and having a base of greater width than the height of said deflector, and said deflector being of such a length as to extend across at least a major portion of the width of a table top;

an open-topped receiving channel located in an apex portion of said deflector, and the width of said receiving channel being inwardly decreasing; and a game board removably positioned in said receiving channel and extending generally vertically thereabove, and said game board having means defining a target associated therewith.

27. A paddle game comprising:

a generally rectangular table having a height generally corresponding to the height of a table tennis table, and said table having a table top defining a substantially flat playing surface;

an elongate deflector positioned on and extending across a central portion of said table top, said deflector having a generally triangular configuration in cross section and having two substantially opposing angular playing surfaces which extend toward each other in intersecting planes to define an apex, and said deflector being of such a length as to extend across at least a major portion of the width of said table top; and a game board removably positioned on and cooperating with said deflector, said game board extending generally vertically above said apex of said deflector, wherein the height of said game board and said apex is a distance substantially less than the height of said table, and said game board having means defining a target associated therewith.

28. A paddle game assemblage comprising:

an elongate deflector adapted for resting on a table top, said deflector having a generally triangular configuration in cross section and having two angled sides defining two playing surfaces which extend toward each other in intersecting planes defining an apex;

a plurality of game boards adapted to be selectively interchangeably positioned on said deflector, each of said game boards defining a different game playable by one or more players, and each of said game boards having means defining a target associated therewith; and means associated with an apex portion of said deflector for selectively maintaining one of said plurality of game boards in a generally upright position.

29. A paddle game according to claim 28 further including instructional materials for providing guidance in playing and scoring the paddle game.

30. A paddle game according to claim 28 wherein said means for maintaining said game board in position comprises an open-topped receiving channel located in said apex portion of said deflector, the width of said receiving channel being inwardly decreasing.

31. A paddle game according to claim 28 wherein said means for maintaining said game board in position comprises an open-topped receiving channel located in said apex portion of said deflector, and said receiving channel having inwardly biased sidewalls to restrict access to said receiving channel for resiliently grasping said game board therebetween.

32. A paddle game according to claim 31 wherein said deflector is formed of plastic.

33. A paddle game according to claim 28 wherein said opposed angular playing surfaces each defines an angle of between 40 and 50 degrees.

34. A paddle game according to claim 33 wherein said opposed playing surfaces each defines an angle of the same degree.

35. A paddle game according to claim 33 wherein said opposed playing surfaces have an angle of 45 degrees.

36. A paddle game according to claim 28 wherein at least one of said plurality of game boards includes an opening therein of a size adapted to permit passage of a game ball, such as a table tennis ball, therethrough.

37. A paddle game according to claim 28 wherein at least one of said plurality of game boards has printed indica on at least one face thereof depicting a particular competitive game, such as an athletic event, to be played.

38. A paddle game according to claim 28 wherein at least one of said plurality of game boards comprises a different game depicted on opposed faces thereof adapted to be selectively played by one or more players positioned on the same side of the deflector.

39. A paddle game according to claim 28 wherein at least one of said plurality of game boards comprises the same game depicted on opposed faces thereof adapted for use by players positioned on opposing sides of said deflector.

40. A paddle game comprising:

a generally rectangular collapsible game table having a center section and a pair of leaves, one of said pair of leaves being connected at opposed ends of said center section, and each of said pair of leaves being selectively movable between a storage position and a use position wherein said pair of leaves and said center section form a generally uniform table top defining a substantially continuous playing surface, and said game table having a pair of foldable supports connected to said center section for selectively supporting said pair of leaves in the use position;

a deflector adapted for resting on said playing surface, said deflector having a generally triangular configuration in cross section and having two angled sides defining two playing surfaces which extend toward each other in intersecting planes and face in opposition to each other, and said deflector being of such a length as to extend across at least a major portion of the width of the table top; and a game board positioned on and cooperating with said deflector, said game board extending generally vertically above said apex of said deflector, and said game board having means defining a target associated therewith for use by the players.

41. A paddle game according to claim 40 further including wheels connected to said center section of said table adjacent the corners thereof and also connected to each of said pair of supports for facilitating assembly and any desired movement of said game table.

42. A paddle game according to claim 40 further comprising a built-in storage compartment and a drawer positioned within said center section for storage of said game board and said deflector.

43. A paddle game according to claim 40 wherein each of said pair of supports has a generally Z-shaped configuration in horizonal cross-section, and each of said pair of supports is movable between a folded position closely adjacent said center section and an extended position wherein each of said pair of supports respectively underlies a major portion of the length and width of said pair of leaves to provide a stable playing surface to the table top.

44. A paddle game table comprising:

a generally rectangular collapsible table having a center section and having a built in storage compartment and drawer formed therein:

a pair of leaves connected to said table wherein one of said pair of leaves is located at opposed ends of said center section, and each of said leaves being selectively movable between a storage position depending downwardly from said center section and a use position wherein said pair of leaves and said center section form a generally uniform table top defining an uninterrupted playing surface; and a pair of foldable supports for selectively supporting said leaves in the use position, each of said pair of supports connected to and alongside said storage compartment and movable between a folded position closely adjacent said storage compartment and an extended position wherein each of said pair of supports respectively underlies a major portion of the length and width of each of said pair of leaves to provide a stable playing surface to the table top.

45. A paddle game table according to claim 44 further including wheels connected to said center section of said table adjacent the corners thereof and also connected to each of said pair of supports for facilitating assembly and movement of said game table.

46. A paddle game table according to claim 44 wherein each of said pair of supports comprises a three legged assembly hingably connected to said storage compartment.

47. A paddle game table according to claim 46 wherein each of said pair of supports has a generally Z-shaped configuration in horizontal cross section.

48. A method of preparing a table top paddle game for play comprising:

providing a generally rectangular table having a table top defining a playing surface, said table having a height corresponding to the height of a table tennis table and having an overall size substantially corresponding to the size of a conventional table tennis table;

positioning an elongate deflector across the central portion of said table top to divide said table top into opposite halves, said deflector being of such length as to extend across at least across a major portion of the width of said table top, and said deflector having two substantially opposing angular playing surfaces which extend toward each other in intersecting planes to define an apex and having an open-tipped receiving channel located therein;

providing a plurality of game boards; and positioning a selected one of said plurality game boards in said receiving channel to extend in a generally upright position above said apex, and wherein said game board has means defining a target associated therewith.

49. A method according to claim 48 further comprising providing a pair of barrier fences removably positionable adjacent opposed ends of said deflector to serve as an extension thereof when the width of said table top is wider than the length of said elongate deflector; and placing one of said pair of barrier fences on opposed ends of said deflector to collectively extend therewith the entire width of said table top.

* * * * *